US005833548A

United States Patent [19]

Ellis et al.

[11] Patent Number: 5,833,548

[45] Date of Patent: Nov. 10, 1998

[54] BOWLING BALL

[75] Inventors: Paul L. Ellis; Brian C. Hearl, both of Newton, Iowa

[73] Assignee: Brunswick Bowling & Billiards Corportion, Muskegon, Mich.

[21] Appl. No.: 816,117

[22] Filed: Mar. 11, 1997

Related U.S. Application Data

[63] Continuation of Ser. No. 627,150, Apr. 13, 1996, abandoned.

[51] Int. Cl.[6] ..... A63B 37/10

[52] U.S. Cl. ..... 473/125; 273/DIG. 20; 473/378; 473/126

[58] Field of Search ..... 273/58 R, 58 A, 273/58 B, 58 BA, 58 K, 61 A, DIG. 20, DIG. 30; 473/351, 367, 371, 375, 378–384, 125, 126, 127

[56] References Cited

U.S. PATENT DOCUMENTS

| | | | |
|---|---|---|---|
| 725,011 | 4/1903 | Richards | 273/58 B |
| 1,409,059 | 3/1922 | Miller . | |
| 1,504,461 | 8/1924 | Whelan . | |
| 1,849,414 | 3/1932 | Turnbull | 473/126 |
| 2,006,230 | 6/1935 | Dobbins | 273/58 A |
| 2,839,301 | 6/1958 | Hunter . | |
| 3,265,392 | 8/1966 | Degner et al. . | |
| 3,740,036 | 6/1973 | Ames | 473/125 |
| 4,613,137 | 9/1986 | Ruckert . | |
| 4,641,839 | 2/1987 | Turner | 473/125 |
| 4,802,671 | 2/1989 | Gentiluomo . | |
| 5,058,901 | 10/1991 | Salvino . | |
| 5,074,553 | 12/1991 | Pawlowski et al. . | |
| 5,280,906 | 1/1994 | Vitale | 273/DIG. 20 |
| 5,437,578 | 8/1995 | Wasserberger et al. . | |

FOREIGN PATENT DOCUMENTS

| | | | |
|---|---|---|---|
| 145707 | 5/1951 | Australia | 473/125 |

*Primary Examiner*—William M. Pierce
*Attorney, Agent, or Firm*—Zarley, McKee, Thomte, Voorhees & Sease

[57] ABSTRACT

A bowling ball has an annular band interposed between two spherical segments so as to define an outer peripheral surface of the spherical ball. The first and second spherical segments have respective outer peripheral surfaces formed of a first material having a hook potential, whereas the annular band has an outer peripheral surface formed of a second material having a hook potential different from the hook potential of the first material. In one embodiment the hook potential of the second material is substantially lower than the hook potential of the first material so as to make the ball less sensitive to conditions in the wet portion of the lane and delay significant hooking action until the dry portion so as to improve entry angle and thereby pin count. One way, albeit imperfect, to approximate the hooking potential of a material is to measure its coefficient of friction. A larger coefficient of friction generally leads to a higher hooking potential. A method of using the ball is also disclosed.

17 Claims, 2 Drawing Sheets

BOWLING BALL

This is a continuation of application Ser. No. 08/627,150 filed on Apr. 13, 1996 now abandoned.

BACKGROUND OF THE INVENTION

The present invention relates to the field of bowling balls. More particularly, this invention relates to a bowling ball for use in the game of tenpins.

Many games or sports involve the use of a hand-held ball which is rolled or thrown. In one such game, known as lawn bowling, the ball is slightly ellipsoidal and has no holes. Thus, the bowler can throw or roll the ball along a different path by merely adjusting the orientation of the ball in the throwing hand.

Another popular game is commonly referred to as bowling or tenpins. In ten-pin bowling, one rolls a spherical ball having fixed finger holes down a lane toward ten pins arranged in triangular pattern at the far end. The object of the game is to knock down as many pins as possible. The player knocking down the most pins achieves the highest score and thereby wins the ten-pin bowling game.

Most modern ten-pin bowling balls include three spaced apart holes into which the bowler inserts his or her thumb and middle two fingers respectively to grip and throw the ball. Other finger hole configurations involving one to five holes have been used in the prior art, but do not currently enjoy much popularity. Although the finger holes prevent reorientation of the ball in the bowler's throwing hand, they also improve the consistency of the bowler's delivery, the resulting ball path, and thereby the bowler's score.

The ten-pin bowling ball commonly used in the United States of America must meet rigid standards promulgated by the American Bowling Congress (hereinafter ABC). For instance, the outside diameter of the bowling ball must be between 8.500 and 8.595 inches. Thus, the circumference of the ten-pin bowling ball must be approximately 27 inches. Pursuant to ABC standards, the ten-pin bowling ball is typically manufactured to be spherical within 0.010 of an inch maximum.

Some bowlers throw a "reverse hook" or "back-up" ball. Other bowlers throw a "straight" ball. However, most successful amateur and professional bowlers throw a "hook" ball because it is believed to produce higher scoring due to increased pin action. Further discussion of the "hook" or curved path ball is found in columns 1 and 2 of Pawlowski and Wasserberger U.S. Pat. No. 5,074,553 issued Dec.24, 1991. Said discussion is incorporated by reference herein.

One of the many challenges in throwing a successful hook ball is optimizing the extent and timing of the hooking action of the ball through varying lane conditions. The lane conditions at each bowling center are established by the lane conditioning practices of the proprietor.

Typically, the proprietor heavily lubricates or oils about the first zero to eighteen feet of the approximately sixty feet between the foul line and the pins. The proprietor also lubricates about the next fifteen to twenty-five feet of the lane, but to a lesser extent. Approximately the last twenty feet of the lane in front of the pins is dry. Thus, the latter portion of the lane is initially the dry portion and the former portions of the lane initially comprise the wet portion. Where present, the layer of lubricant preferably extends completely across the lane in a friction reducing layer that is thicker or more concentrated across the middle of the lane than at its edges. These initial lane conditions may vary from one bowling center to another and from one lane to another in the same bowling center.

Lane conditions may also change over time, even during a single game or match. Balls tend to pick up the lubricant from the lubricated portion of the lane as they slide or roll through it. Then the balls transfer some of the lubricant onto the dry portion of the lane as they continue their way toward the pins. As many balls traverse the lane, the concentration of lubricants is gradually depleted in some areas. Dry spots eventually develop on the "wet" portion of the lane. These dry spots cause the ball to hook prematurely, robbing it of valuable momentum and usually throwing it off target because the classical hook ball movement pattern of slide, roll and hook has been upset. Those skilled in the art refer to this undesirable redistribution of lane lubricant as lane conditioning breakdown.

Therefore, the primary object of the present invention is a provision of an improved ten-pin bowling ball that complies with current ABC standards and consistently provides more controlled, timely and aggressive hooking action, with relatively low sensitivity to varying lane lubrication conditions, causing the ball to hit the pins with more advantageous results.

A further object of the present invention is a provision of a ten-pin bowling ball having an annular band of material forming an outer surface having a different hooking potential than the rest of the ball.

A further object of the present invention is a provision of a ten-pin bowling ball having an annular band of material forming an outer surface having a lower hooking potential than the rest of the ball.

A further object of the present invention is a provision of a ten-pin bowling ball having an annular band of material forming an outer surface having a different coefficient of friction than the rest of the ball.

A further object of the present invention is a provision of a ten-pin bowling ball having an annular band of material forming an outer surface having a lower coefficient of friction than the rest of the ball.

A further object of the present invention is the provision of a ten-pin bowling ball whose exterior surface is cast in a single mold using at least two different materials, so as to result in a distinct annular band, stripe, or spherical zone of one material interposed between spherical segments or end caps of another material having a different hooking potential.

A further object of the present invention is the provision of a ten-pin bowling ball that is simple in construction, economical to produce and durable in use.

These and other objects of the present invention will become apparent to those skilled in the art from the drawings and the description which follows.

SUMMARY OF THE INVENTION

The present invention is a bowling ball having an annular band interposed between two spherical segments so as to define an outer peripheral surface of the ball. The first and second spherical segments have respective outer peripheral surfaces formed of a first material having a hook potential, whereas the annular band has an outer peripheral surface formed of a second material having a hook potential different from the hook potential of the first material. In one embodiment the hook potential of the second material is substantially lower than the hook potential of the first material so as to make the ball less sensitive to conditions on the wet portion of the lane. One way, albeit imperfect, to approximate the hooking potential of a material is to measure its coefficient of friction. A larger coefficient of friction generally leads to a higher hooking potential.

The band can take various forms and widths so long as it provides adequate width to accommodate the variation in the bowler's release and the number of ball tracks required to get the ball to the dry portion of the lane. In one embodiment the band has parallel planar sides, giving it a uniform width, and a uniform thickness.

A method of improving the timeliness of hooking action and thereby pin count using the bowling ball of this invention is also disclosed. The ball of this invention is less sensitive to lane conditioning breakdown and gives the bowler greater control over the timing of hooking action.

DETAILED DESCRIPTION OF THE PREFERRED EMBODIMENT

Figure 1:
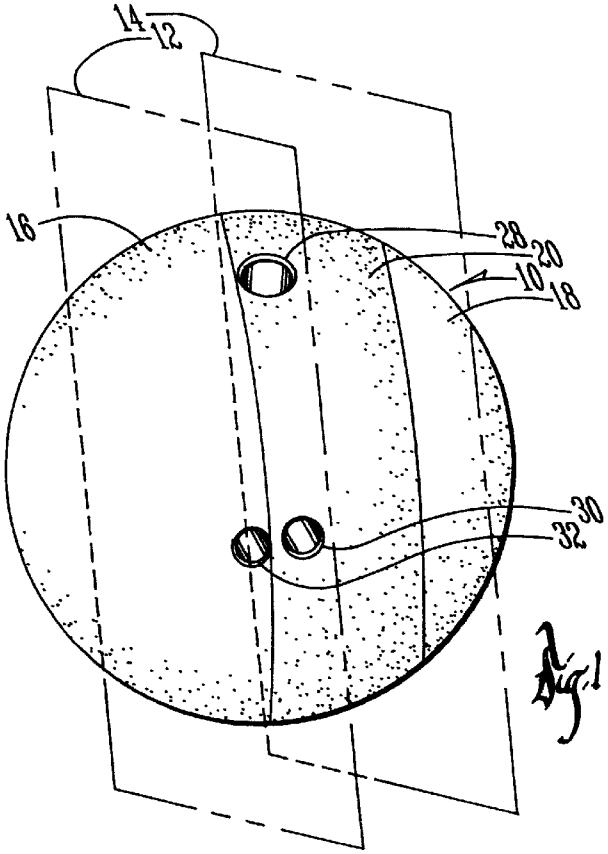
FIG. 1 is a perspective view of the bowling ball of the present invention.
Figure 4:
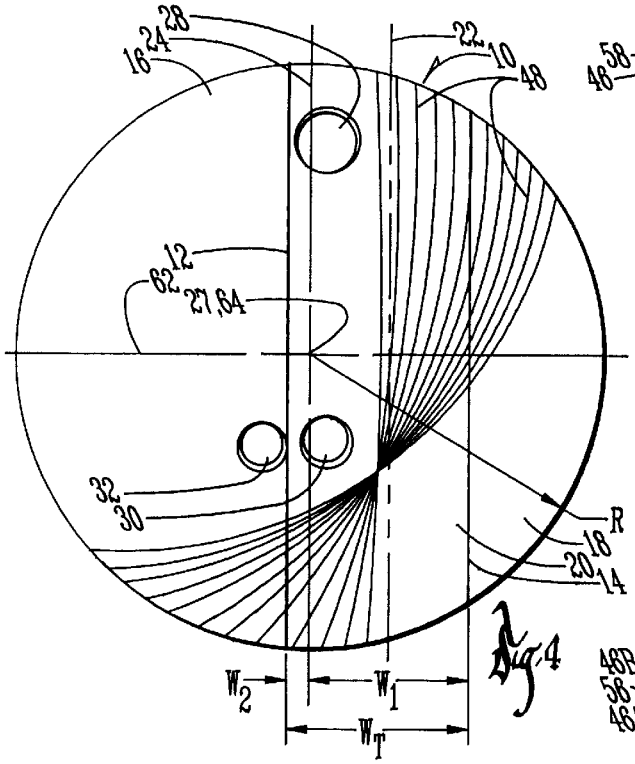
FIG. 4 is a top plan view of the bowling ball of the present invention, which shows the relationship between the band of low hooking potential material and the central vertical plane of the ball.

The ten-pin bowling ball of the present invention is generally denoted by the reference number 10 in the drawings and the description which follows. In FIG. 1, a pair of spaced apart vertical planes 12, 14 extend through the bowling ball 10 to segregate it into distinct areas. Preferably the planes 12 and 14 are parallel so as to divide the spherical ball 10 into two opposing spherical segments 16, 18 and a spherical zone or annular band 20 interposed therebetween. As best seen in FIG. 4, the band 20 has a central peripheral circle 22 that is offset from the equatorial great circle 24 of the ball 10.

Figure 2:
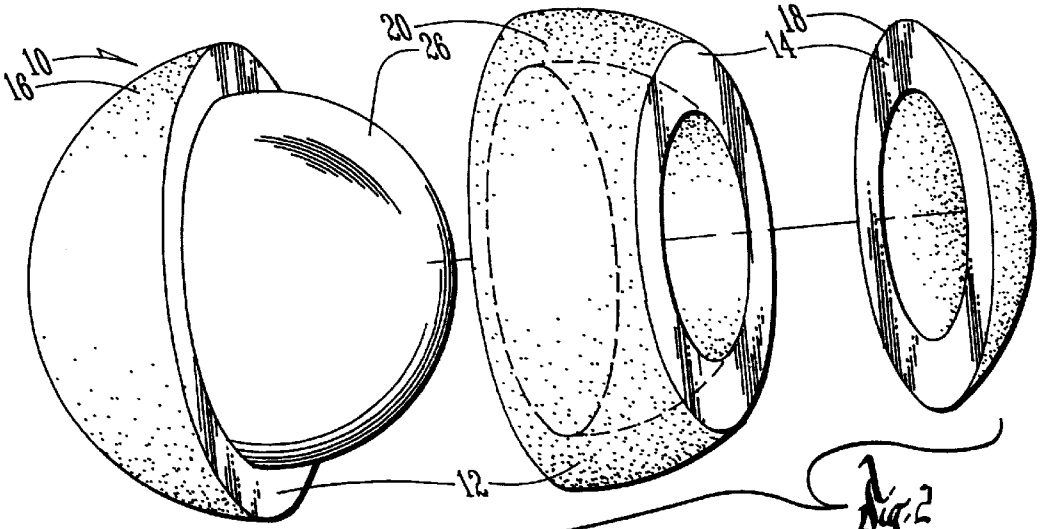
FIG. 2 is an exploded view of the bowling ball of FIG. 1.

FIG. 2 discloses the interior construction of the ten-pin bowling ball 10 of this invention. The bowling ball 10 is cast as a hollow sphere surrounding a core 26. However, other manufacturing techniques may be utilized to achieve the same finished article without detracting significantly from the present invention. Conventional materials form the core 26 and it is weighted as is well known in the art.

The spherical segments 16 and 18 can also be constructed of a conventional material used for bowling ball coverstocks or shells, such as polyurethane. Other materials would be acceptable if they provided the key parameters of a relatively high coefficient of friction at the surface of the ball 10 and a relatively high "hook potential."

The ABC regulates and measures the maximum allowable (coefficient of) friction between a bowling ball and an unoiled piece of synthetic lane surface. However, actual frictional performance or hooking potential on a wet-dry wood or synthetic lane can deviate from predictions that are based solely on ABC "dry lane" coefficient of friction values. Therefore, although it is somewhat harder to define, a relatively high hook potential material is the preferred parameter. The coefficient of friction value can be used to make an initial selection of the material, but the hook potential of the particular material(s) selected should be verified by testing a ball on a wet-dry lane.

Figure 3:
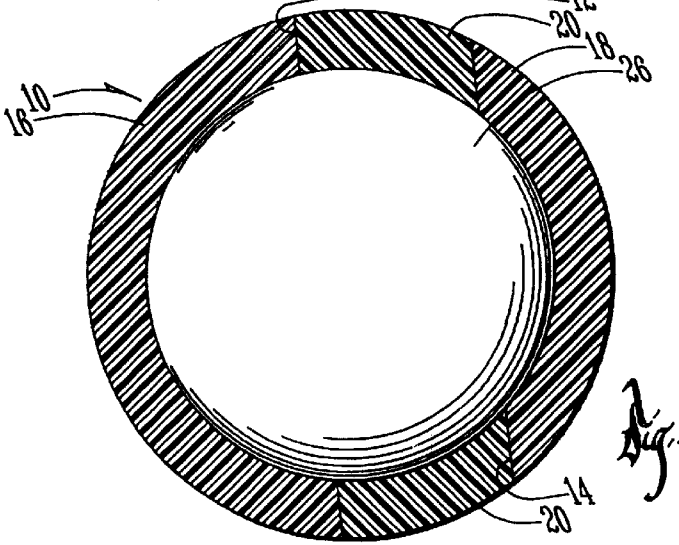
FIG. 3 is a cross sectional view taken along line 3—3 in FIG. 2 of the bowling ball of the present invention.

By contrast, the spherical zone or band 20 is constructed of conventional materials having a different hook potential than the segments 16, 18. Preferably the material forming the spherical zone or band 20 has a hook potential and/or coefficient of friction which is lower than the hooking potential and/or coefficient of friction of the spherical segments 16, 18. The preferred material for the band is a different polyurethane than that used on the segments 16, 18. Of course, various combinations of materials meeting the parameters stated herein are contemplated. The relation of the band 20 to the segments 16, 18 and the core 26 is further shown in FIG. 3.

In the best mode contemplated by the inventors, the material of the band 20 is a cured mixture of liquid polyol having the trade name Baytec 153B mixed with a liquid isocyanate having the trade name Baytec 151A. By weight the mixture comprises 60–70%, more preferably 65%, Baytec 153 B and 30–40%, more preferably 35%, Baytec 151A. The material of the end caps or segments 16, 18 is a cured mixture of liquid polyol having the trade name Baytec 174B mixed with Baytec 151A isocyanate. By weight the end cap mixture comprises 60–75%, more preferably 67 %, Baytec 174B and 25–40%, more preferably 33%, Baytec 151A. The Baytec materials are available from Bayer Inc., 100 Bayer Road, Pittsburgh, Pa. U.S.A. 15205-9741.

Referring to FIG. 4, the outer surface area A of the band 20 can be determined by the following equation:

$$A=2\pi R_1+2\pi RW_2$$

where

R equals the radius of the great circle of the ball 10 which has a center 27;

$W_1$ equals the width of the band on one side of the equatorial great circle 24 of the ball 10; and $W_2$ equals the width of the band 20 on the other side of the equatorial great circle 24 of the ball.

On a conventionally sized ball, where the circumference $2\pi R$ equals approximately 27 inches, it is preferred that the total width of the zone, stripe, or band 20, represented by $W_T=W_1+W_2$ , be approximately between two and five inches, preferably 3.0 to 4.0 inches, and more preferably about 3.5 inches. The central peripheral circle 22 of the band 20 bisects its width $W_T$.

Figure 5:
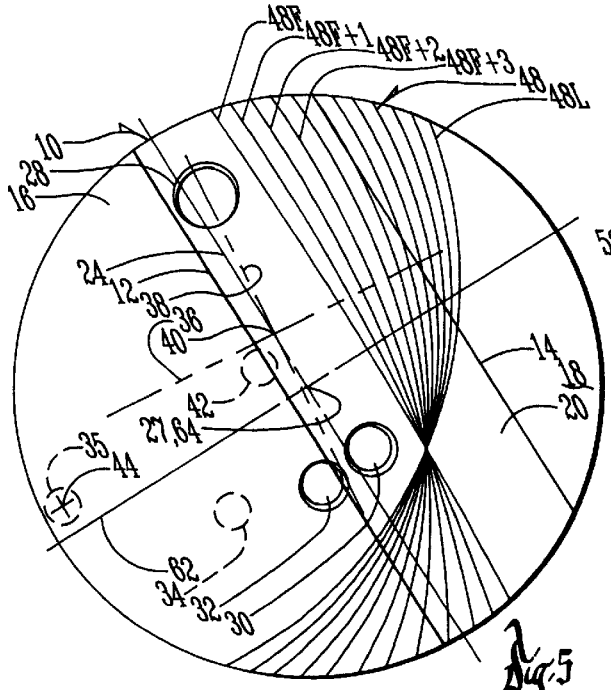
FIG. 5 is a top plan view of the bowling ball of the present invention, which shows the finger holes and other relevant reference features, including the rolling tracks, on the ball.

One of the things that sets the sport of tenpin bowling apart from lawn bowling is that the tenpin bowler strives to grip the ball 10 in a consistent position each time he or she throws it. Therefore, a set of finger holes 28, 30, 32 are provided in fixed positions on the ten-pin bowling ball 10. Hole 28 receives the bowler's thumb, hole 30 receives the bowler's middle finger, and hole 32 receives the bowler's "ring" finger. Holes 28, 30 and 32 are custom drilled into the ball 10 to meet the specifications of the purchaser or individual bowler. As shown in FIG. 5, a first reference pin or construction hole 34 is cast into the ball 10 in order to provide a consistent reference point or datum from which the finger holes 28, 30, 32 can be drilled. A second reference pin or construction hole 35 coincides with the desired spin axis 44 of the ball 10 and further assists in locating the finger holes 28, 30, 32 and other features of the ball 10.

The finger holes 28, 30, 32 define a pair of grip axes 36, 38 as shown in FIG. 5. The inter-section of the grip axis 36, 38 establishes a grip center 40. Due to the loss of material removed for the finger holes 28, 30, 32, the core is offset to create a center of gravity in the direction of the heavy spot 42 from the center 27 of the ball 10. The heavy spot 42 should be close to the grip center 40 in order to stay within legal ABC limits. When a hook ball bowler throws the ball 10, it spins or rotates about a spin axis 44.

While the bowling ball 10 spins about the spin axis 44 and translates down the lane 46, the ball contacts the lane 46 along a continuous track 48 that is preferably parallel to the equatorial great circle 24 of the ball. Because of the mass distribution in the ball 10, and the way the mass distribution is oriented to the bowler's release or grip axes 36, 38, the ball 10 also rotates such that ball track 48 tends to migrate with respect to the centerline or equatorial great circle 24 of the ball 10. The first portion $\mathbf{48}_F$ of the track 48 is approximately parallel to the equatorial great circle 24 of the ball 10. However, as the ball 10 continues to translate and rotate down the lane 46, the track 48 progressively migrates (or curves in the two-dimensional view) away from the equatorial great circle 24 of the ball 10 until the ball 10 hits the pins or leaves the lane 46 along the last portion $\mathbf{48}_L$ of the track 48.

The band 20 should generally be wide enough to easily accommodate the normal variation in the bowler's release and the migration of two to four ball tracks $\mathbf{48}_F$, $\mathbf{48}_{F+1}$, $\mathbf{48}_{F+2}$, $\mathbf{48}_{F+3}$ across the band 20 to ensure that the hooking action/friction is minimized through the first one-third of the lane 46 and the ball 10 generally skid-rolls over that portion of the lane 46.

Figure 6:
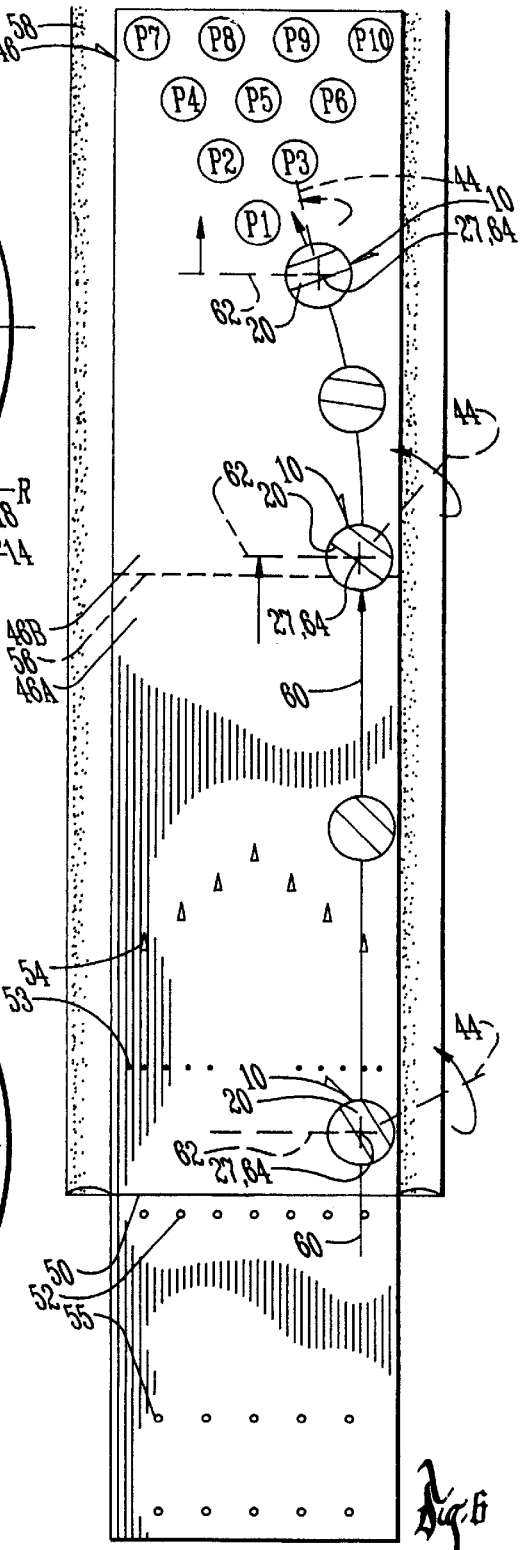
FIG. 6 is a top plan view of the lane in a bowling center and shows the path of the bowling ball of the present invention when thrown as a "hook" ball by a right-handed bowler.

The use of the ball 10 of the present invention and its advantages can be better understood in view of FIG. 6. A set of ten-pins $P_1$–$P_{10}$ are set upright in a predetermined pattern at one end of the lane 46 according to ABC standards. Staying behind a foul line 50 at the other end of the lane 46, the bowler throws the ball 10 toward the pins $P_1$–$P_{10}$.

The lane 46 includes several sets of markings 50, 52, 53, 54, 55 pursuant to ABC standards. A set of lane dots 52 is located just behind the foul line 50. Another set of lane dots 53 is provided beyond the foul line 50 and conventionally located as shown, as is a set of arrows 54. The dots 53 and/or the arrows 54 can be used by the bowler for aiming purposes. For instance, the bowler may choose to try to roll the bowling ball 10 across one or more of the dots 53 and arrows 54 so that the path of the ball will terminate in the "pocket" of the pins, usually between $P_1$ and $P_3$ for a right handed bowler as shown or between $P_1$ , and $P_2$ for a left handed bowler. Two rows of markers 55 extend across the lane 46 at twelve and fifteen feet behind the foul line 50, respectively.

As discussed above, the lane 46 generally has two main portions. For purposes of illustration only, an imaginary demarcation line 56 divides the wet portion 46A of the lane 46 from the dry portion 46B. Finally, the nightmare of every bowler is to have their ball miss the pins entirely and wind up in the gutter 58 provided along either side of the lane 46. Although the basic structure of each lane 46 of the bowling center is dictated by ABC standards, it merits mentioning here because the present invention allows the bowler to take greater advantage of the layout and condition of the lane 46.

FIG. 5 shows the structure of the banded bowling ball 10 and FIG. 6 illustrates the typical hook ball path that the bowling ball 10 provides. The bowler approaches the foul line 50 and throws or rolls the ball 10 onto the wet portion 46A of the lane 46. The ball 10 travels along a ball path 60. The ball 10 slides or rolls about a roll axis 62 which extends through the center 27 of the ball 10. For most balls the roll axis 62 extends parallel to approximately twenty-five degrees skewed from the surface of the lane 46. The ball 10 also simultaneously spins about the spin axis 44. As the ball 10 transitions from sliding to rolling, the simultaneous rotation about the two axes 44, 62 causes movement, due to precession, about a third axis which is a vertical axis 64 through the center 27 of the ball perpendicular to the roll axis 62.

Initially following its release, the ball 10 contacts the lane 46 on the outer surface of the band or spherical zone 20 and begins to slide along the first track $\mathbf{48}_F$. Because the band or spherical zone 20 comprises a material with a comparatively low hook potential and/or low coefficient of friction, the ball 10 tends to slide and later roll quickly through the oiled or wet portion 46A of the lane 46 without hooking substantially toward the head pin $P_l$. Furthermore, the band 20 makes the ball 10 less sensitive to varying lane conditions or lane conditioning breakdown.

Gradually, because of the hook or curve spin imparted on the ball 10 by the bowler in the direction of the arrow about its spin axis, the ball track 48 begins to migrate outside of the band 20 and onto the higher hooking potential and/or higher coefficient of friction material of the spherical segments 16, 18. Due to the width $W_T$ and placement of the annular band 20, the ball 10 begins to track into the higher coefficient of friction or hook potential material in the second third of the lane 46. Then the ball track 48 progressively migrates into greater contact with the segments 16, 18 and lesser contact with the band 20 as the ball 10 continues into the dry portion 46B of the lane 46. The higher hook potential material of segments 16, 18 causes the ball 10 to hook more aggressively on the dry portion 46B of the lane 46. Thus, a strong hooking action is imparted on the ball 10 just before it hits the pins $P_1$–$P_{10}$. This strong ball action translates into a very desirable large entry angle into the pins $P_1$–$P_{10}$ and thereby high scoring. The sliding and rolling of the bowling ball 10 on the low hooking potential or low friction band 20 through the oiled portion 46A of the lane 46 provides more timely, aggressive, and consistent hooking action later on the dry portion 46B.

Thus it can be seen that the present invention at least accomplishes its stated objects.

It would be appreciated that the present invention can take many forms and embodiments. In particular, it is contemplated that the band could have a wedge-shaped cross-section to facilitate its retention between the segments. The band sides could also be angled with respect to each other so as to form various configurations resembling a bow tie or hour glass pattern on the surface of the ball. Such surface configurations would be advantageous given the usual ball track pattern for a hook ball. It is also contemplated that the band could have a higher hook potential than the segments, such that the ball first tracks primarily on high hook potential material when released. The finger holes can also be drilled so that the ball tracks will terminate their migration on the high hook potential band rather than on the segments. The true essence and spirit of this invention are defined in the appended claims, and it is not intended that the embodiment of the invention presented herein should limit the scope hereof.

What is claimed is:

1. A ten-pin bowling ball comprising:

a spherical ball including a first spherical segment, a second spherical segment and an annular band interposed therebetween so as to collectively define an outer peripheral surface of the ball; and the annular band having an outer peripheral surface formed of a substantially nondeformable material having a lower sliding and rolling hook potential than the first spherical segment and the second spherical segment.

2. The bowling ball of claim 1 wherein the first and second spherical segments have respective rolling and sliding hook potentials that are substantially the same.

3. The bowling ball of claim 1 wherein the first spherical segment and the second spherical segment each have an outer surface formed by the same material.

4. The bowling ball of claim 3 wherein the second material and third material are substantially the same.

5. The bowling ball of claim 1 wherein the annular band has a pair of substantially planar and generally opposing side surfaces.

6. The bowling ball of claim 1 wherein the side surfaces of the annular band are parallel such that the annular band extends continuously around the spherical ball and has a uniform width.

7. The bowling ball of claim 6, wherein the band is between 3.0 inches and 4.0 inches wide.

8. The bowling ball of claim 6 wherein the annular band of the second material has a uniform radial thickness.

9. The bowling ball of claim 6 wherein the spherical ball has a center, an equatorial great circle extending around the center, and a meridian great circle perpendicular to the equatorial great circle; the band including a central peripheral circle which bisects the width of the band and is noncoincidental with the equatorial great circle of the spherical ball.

10. The bowling ball of claim 9 wherein the band includes a central peripheral circle which is offset from and parallel to the equatorial great circle.

11. The bowling ball of claim 9 wherein the spherical ball has a construction hole extending radially thereinto from the outer peripheral surface in a predetermined location with respect to the equatorial and meridian great circles, the band being in a predetermined position with respect to the construction hole.

12. The bowling ball of claim 11 wherein the spherical ball includes a thumb hole for receiving the thumb of a bowler and at least one finger hole for receiving the finger of the bowler, the band and the thumb hole and finger hole being in a predetermined pattern with respect to the construction hole.

13. The bowling ball of claim 1 wherein the spherical ball has a center and a radius extending therefrom to define an equatorial great circle on the outer peripheral surface of the spherical ball and the band overlaps the equatorial great circle.

14. A method of improving timeliness of hooking action of a bowling ball in a tenpins game played on an elongated substantially rigid lane having a wet portion at one end and a dry portion at another end, comprising:

providing a spherical bowling ball having an annular band thereon interposed between two spherical segments, the annular band including an outer peripheral surface formed of a material having a lower sliding and rolling hook potential than the spherical segments;

grasping the ball such that the band is generally aligned with a target on the lane;

approaching the wet portion of the lane with the ball;

releasing and rollingly sliding the ball onto the wet portion of the lane, toward the target and the dry portion of the lane, along the annular band with a spinning motion about a spin axis noncoincidental with a rolling axis, the ball contacting the lane so as to define a ball track extending around the ball and remaining on the annular band during at least one complete revolution of the ball about the rolling axis then progressively migrating toward the segments with each subsequent revolution of the ball until the ball track resides primarily on the segments while the ball traverses the dry portion of the lane;

whereby the ball delays hooking action while traversing the wet portion of the lane primarily on the band and encourages hooking action while traversing the dry portion of the lane primarily on the segments.

15. A ten-pin bowling ball comprising:

a substantially nondeformable spherical ball including an annular band adjacent a spherical segment;

the band and the segment each having an outer peripheral surface formed of a first material and a second material respectively, wherein the first material has a coefficient of friction lower than the second material.

16.The bowling ball of claim 15 further comprising a second spherical segment adjacent to the annular band wherein the first spherical segment and the second spherical segment have respective coefficients of friction that are substantially the same.

17. The bowling ball of claim 15 further comprising a second spherical segment adjacent the band and having an outer peripheral surface formed of a third material, wherein the coefficient of friction of the first material is lower than the third material.

* * * * *